United States Patent [19]

Farrenkopf et al.

[11] Patent Number: 4,892,475

[45] Date of Patent: Jan. 9, 1990

[54] IGNITION SYSTEM AND METHOD FOR POST-MIXED BURNER

[75] Inventors: Dennis R. Farrenkopf, Bethel, Conn.; William J. Snyder, Ossining, N.Y.

[73] Assignee: Union Carbide Corporation, Danbury, Conn.

[21] Appl. No.: 281,459

[22] Filed: Dec. 8, 1988

[51] Int. Cl.[4] ..... F23C 5/00; F23Q 7/06

[52] U.S. Cl. ..... 431/8; 431/263; 431/266

[58] Field of Search ..... 431/8, 174, 187, 263, 431/264, 258, 266; 60/39.827

[56] References Cited

U.S. PATENT DOCUMENTS

| | | | |
|---|---|---|---|
| 1,981,299 | 11/1934 | Beckler | 219/32 |
| 2,526,169 | 10/1950 | Steeg | 431/263 X |
| 2,865,441 | 12/1958 | Coupe | 158/28 |
| 2,996,113 | 8/1961 | Williams | 158/115 |
| 3,071,182 | 1/1963 | Delano | 158/28 |
| 3,122,212 | 2/1964 | Karlovitz | 175/14 |
| 3,134,423 | 5/1964 | Smith | 431/263 X |
| 3,150,710 | 9/1964 | Miller | 158/115 |
| 3,167,109 | 1/1965 | Wobig | 158/73 |
| 3,339,617 | 9/1967 | Saha | 431/263 |
| 3,439,995 | 4/1969 | Hattori et al. | 431/266 |
| 3,556,706 | 1/1971 | Campbell | 431/265 |
| 3,558,251 | 1/1971 | Bauger et al. | 431/266 |
| 3,574,499 | 4/1971 | Turpin et al. | 431/158 |
| 3,589,845 | 6/1971 | Morse et al. | 431/263 X |
| 3,614,280 | 10/1972 | Yamaguchi | 431/25 |
| 4,023,351 | 5/1977 | Beyler et al. | 60/39.74 B |
| 4,228,747 | 10/1980 | Smirlock et al. | 110/347 |
| 4,431,400 | 2/1984 | Kobayashi et al. | 431/6 |

FOREIGN PATENT DOCUMENTS

| | | | |
|---|---|---|---|
| 421854 | 3/1974 | U.S.S.R. | 431/ |

*Primary Examiner*—Randall L. Green
*Attorney, Agent, or Firm*—Stanley Ktorides

[57] ABSTRACT

An ignition system and method for a post-mixed burner characterized by an igniter comprising a tube for igniter oxidant flow and having an electrode therein, said tube positioned within the fuel passage but recessed from the discharge end of the fuel passage and from the combustion zone.

18 Claims, 2 Drawing Sheets

FIG. 1
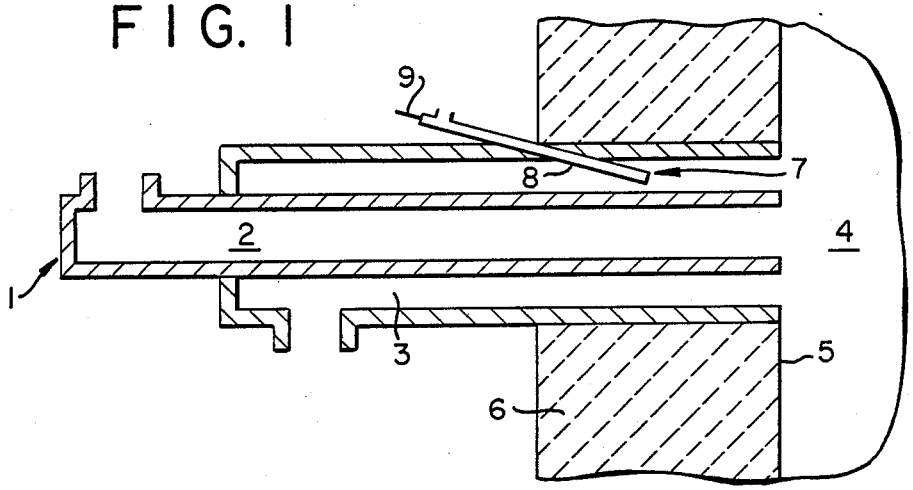
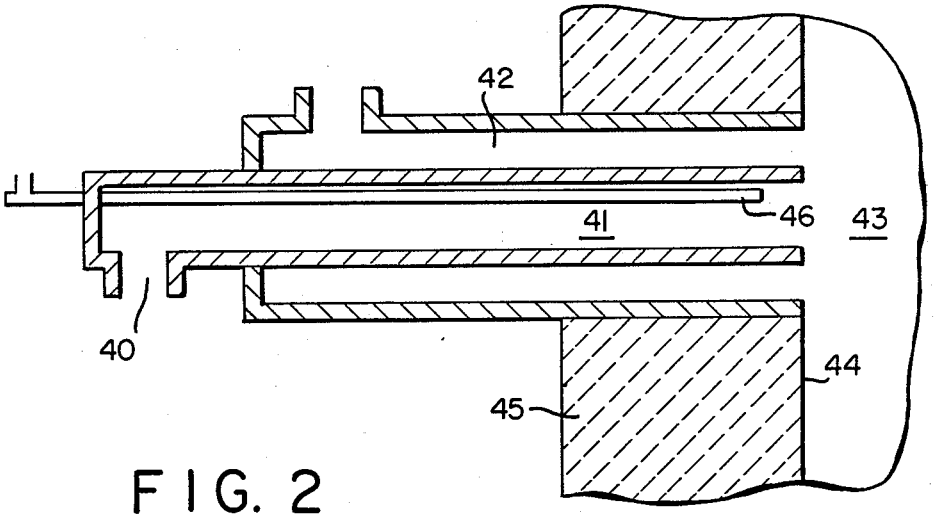
FIG. 2

IGNITION SYSTEM AND METHOD FOR POST-MIXED BURNER

TECHNICAL FIELD

This invention relates generally to the field of post-mixed burners and, in particular, to ignition systems for post-mixed burners.

BACKGROUND ART

A post mixed burner is a burner wherein fuel and oxidant are delivered in separate passages to a point outside the burner, such as a furnace or other combustion zone, where the fuel and oxidant mix and combust.

A problem in the use of post mixed burners is the operation of a reliable ignition system. Because, in the operation of a post mixed burner the combustible mixture is formed not within the burner but in the combustion zone, the ignition system must be within or close to the combustion zone, thus exposing the ignition system to the harsh environment of the combustion zone. This is especially the case where oxygen is used as the oxidant since oxygen burners typically do not employ a burner block which may provide some protection from the radiant heat of the furnace.

In addition to the problem of reduced reliability due to the high heat resulting from the proximity of the ignition system to the combustion zone, another problem encountered by post mixed burner ignition systems is degradation of the ignition system causing compromised operation.

Generally the ignition system comprises some type of electrical discharge or spark generating device having electric surfaces which must be kept clean in order to operate properly. The proximity of the ignition system to the furnace zone exposes such electric surfaces to corrosive oxidizing atmospheres which create difficulties in maintaining the electric surfaces clean and intact. Moreover, impurities in the fuel may hinder the operation of the ignition system. Such impurities include moisture, which causes corrosion of the electric surfaces and can short the electrode to ground, and particulates, either originally within the fuel or as a result of incomplete combustion, which tend to foul the electric surfaces. Such impurities cause spark generation to be reduced or even totally halted requiring a time consuming and expensive cleaning or replacement of the ignition system.

Accordingly it is an object of this invention to provide a post mixed burner having an ignition system which need not be within or next to the combustion zone and, in addition, can remain free of operation compromising contaminants better than can conventional ignition systems.

It is another object of this invention to provide a method for igniting a post-mixed burner with increased reliability over conventional post mixed burner ignition systems.

SUMMARY OF THE INVENTION

The above and other objects which will become apparent to those skilled in the art upon a reading of this disclosure are attained by the present invention one aspect of which is:

A post-mixed burner comprising:

(A) a main oxidant passage having a discharge end for supplying main oxidant into a combustion zone;

(B) a fuel passage having a discharge end for supplying fuel into the combustion zone separately from the main oxidant; and (C) an igniter positioned within the fuel passage and recessed from the discharge end of the fuel passage, said igniter comprising a tube in flow communication with a source of oxidant having an oxygen concentration greater than that of air, and an electrode positioned within the tube.

Another aspect of the invention is:

A method for igniting a combustible mixture comprising:

(A) passing main oxidant into a combustion zone from the discharge end of a main oxidant passage;

(B) passing fuel into the combustion zone, separately from the main oxidant, from the discharge end of a fuel passage to form a combustible mixture in the combustion zone;

(C) passing igniter oxidant having an oxygen concentration greater than that of air through a tube containing an electrode into the fuel passage at a point recessed from the discharge end of the fuel passage;

(D) creating a spark from the electrode to cause combustion of fuel and igniter oxidant within the fuel passage; and (E) passing combusting fuel and igniter oxidant from the fuel passage into the combustion zone to ignite the combustible mixture.

As used herein the term "electrode" means any electrically-conducting material, such as stainless steel, brass, or tungsten, which enables the discharge of electrical energy at a specified location which is usually removed from the electric potential source.

BRIEF DESCRIPTION OF THE DRAWINGS

FIG. 1 is a cross-sectional view of one embodiment of the post-mixed burner of this invention wherein main oxidant is provided into the combustion zone through a central passage and fuel is provided into the combustion zone through a passage concentrically oriented around and along the central passage.

FIG. 2 is a cross-sectional view of another embodiment of the post mixed burner of this invention wherein fuel is provided into the combustion zone through a central passage and main oxidant is provided into the combustion zone through a passage concentrically oriented around and along the central passage.

DETAILED DESCRIPTION

Figure 3:
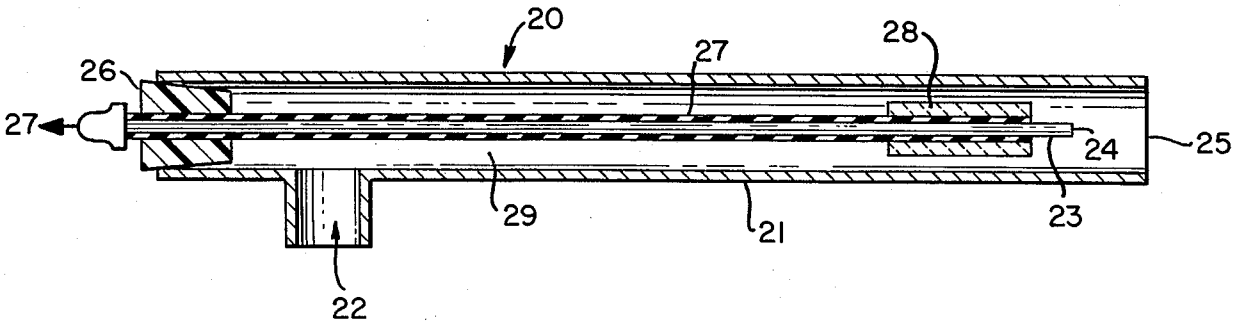
FIG. 3 is a cross sectional view of one embodiment of the igniter useful with the post-mixed burner of this invention.

The invention may be practiced with any post-mixed burner configuration wherein fuel and oxidant are supplied into the combustion zone through separate passages. The invention will be described in detail with reference to the Drawings which illustrate one such configuration wherein the fuel and oxidant are provided into the combustion zone through concentric passages. Other configurations include, for example, the provision of fuel and oxidant into the combustion zone through side by side passages.

Referring now to FIG. 1, post-mixed burner 1 comprises central main oxidant passage 2 in flow communication with a source of oxidant (not shown), and concentric fuel passage 3 in flow communication with a source of fuel (not shown). The main oxidant may be air, technically pure oxygen having an oxygen concentration of at least 99.5 percent, or oxygen-enriched air having an oxygen concentration greater than 21 percent. Preferably the fuel is a gaseous fuel examples of which include natural gas, methane, coke oven gas, hydrogen, propane, carbon monoxide and blast furnace gas.

The fuel and oxidant are passed separately into combustion zone 4 through the discharge ends of their respective passages and form a combustible mixture within combustion zone 4. The fuel and oxidant will flow into the combustion zone to effect a firing rate within the range of from 1.0 to 25.0 million BTU/HR during high fire conditions and within the range of from 0.25 to 1.0 million BTU/HR during low fire conditions. As illustrated in FIG. 1, the fuel and oxidant passages may have their discharge ends flush with the edge 5 of furnace wall 6 which defines the combustion zone. That is, both of the discharge ends are in the same plane. Alternatively, one or both of the discharge ends could be recessed from the plane formed by edge 5.

It is preferred that the discharge end of the fuel passage not contain any nozzle or other impediment to the flow of fluid from the fuel passage into the combustion zone. A nozzle may impede the ignition flame from the igniter from passing into the combustion zone. Moreover, the nozzle could become clogged causing an explosive mixture to form within the fuel passage.

The burner of this invention is characterized by an igniter 7 positioned within the fuel passage so that its discharge end is recessed from the discharge end of the fuel passage preferably by at least about 4 inches and up to about 12 inches. The igniter comprises a tube 8 in flow communication with a source of oxidant (not shown), and an electrode 9 positioned within tube 8. In the embodiment illustrated in FIG. 1, igniter 7 passes through the side wall of fuel passage 3 at an angle to the fuel flow so that igniter oxidant flowing through tube 8 is passed into the fuel passage at an angle to the direction in which fuel is flowing in the fuel passage toward the discharge end. If oriented at an angle, the igniter is angled up to 45° and preferably within the range of from 5° to 15° of the fuel passage. The igniter will be described in greater detail with reference to FIG. 3.

Referring now to FIG. 3, igniter 20 comprises tube 21 which is in flow communication 22 with a source of oxidant (not shown). The igniter oxidant must have an oxygen content greater than that of air. If air were employed as the igniter oxidant, the igniter flame would be stable only at very low flowrates and furthermore would be very short requiring that the igniter be very close to or flush with the fuel passage discharge end. Still further, compressed air sources may have moisture or oil contaminants which would promote igniter degradation and malfunction. The greater is the oxygen concentration of the igniter oxidant, the further the igniter may be recessed from the fuel passage discharge end and thus the greater protection which may be afforded the igniter. Preferably the igniter oxidant has an oxygen concentration exceeding 30 percent. If the main oxidant has an oxygen concentration greater than that of air, the igniter oxidant source may be the same as the main oxidant source. Typical oxidant sources include oxygen storage tanks or, for larger flowrate requirements, air separation plants.

Generally the igniter oxidant passed through the igniter will be at a flow rate within the range of from 8 to 50 cubic feet per hour (cfh). This flowrate is generally within the range of from 0.8 to 5.0 percent of the main oxidant flowrate during low fire operation. Preferably tube 21 is made of metal such as stainless steel or inconel.

Within tube 21 is electrode 23 which extends along the length of tube 21 and whose sparking end 24 may be flush with or, as illustrated in FIG. 3, recessed from the discharge end 25 of tube 21. If recessed, the recession is generally within the range of from $\frac{3}{8}$ to 1 inch. Electrode 23 is held in place within tube 21 by any suitable means such as by insulated plug 26 illustrated in FIG. 3. Electrode 23 is connected to a source of electric potential 27 (not shown) which is sufficient to cause a spark to be generated at sparking end 24. An electric transformer is preferably used as a source of electric potential. It steps up normal electric potentials (120 volts) to, for example, 6000 volts. This potential is then transferred to the electrode end 27 by means of a flexible ignition wire. Other examples of electric potential sources are capacitive discharge, piezo electric elements, and static charge generators.

It is preferred that the spark be generated at sparking end 24. In FIG. 3 there is illustrated one way of accomplishing this wherein electrode 23 is coated with polytetrafluoroethylene insulation along its entire length except for the part near sparking end 24, and furthermore the portion of electrode 23 near the uninsulated length is further insulated with ceramic insulation 28. The electrode may also be uninsulated and the air gap between the electrode and the igniter tube serves to inhibit sparking at other than the electrode tip. Sparking at the electrode tip is accomplished by, for example, bending the sparking end 24 toward tube 21. In this way the spark will arc from electrode 23 to tube 21 at the shortest distance between them, i.e. at sparking end 24.

In operation, igniter oxidant from source 22 is passed through passage 29 formed by tube 21, through discharge end 25 and into the fuel passage at a point upstream, i.e. recessed, from the discharge end of the fuel passage. This causes the formation of a combustible mixture proximate the discharge end 25. An electric potential is applied to electrode 23 causing a spark to form at sparking end 24. The igniter oxidant flowing through the igniter tube pushes the spark to the tip of the igniter causing the combustible mixture proximate discharge end 25 to ignite. The combusting fuel and igniter oxidant are then passed into the combustion zone by the action of the flowing fuel in the fuel passage and serve to ignite the combustible mixture in the combustion zone. Once the post-mixed burner is ignited, the flow of oxidant to the igniter and the electric potential supply are terminated and the combustion inside the fuel passage ceases.

FIG. 2 illustrates another embodiment of the burner of this invention which will now be briefly described. Referring now to FIG. 2 post-mixed burner 40 comprises central fuel passage 41 in flow communication with a source of fuel (not shown), and concentric main oxidant passage 42 in flow communication with a source of oxidant (not shown). The fuel and oxidant are passed separately into combustion zone 43 through the discharge ends of their respective passages which are flush with edge 44 of furnace wall 45, and form a combustible mixture within combustion zone 43. Igniter 46 is positioned within fuel passage 41 so that its discharge end is recessed from the discharge end of the fuel passage. In the embodiment illustrated in FIG. 2, igniter 46 passes through the back wall of fuel passage 41, is positioned proximate to and axially along the inside wall of fuel passage 41, and discharges the igniter oxidant into the flowing fuel in the same direction as that of the flowing fuel toward the discharge end. The positioning of the igniter proximate to the inside wall of the fuel passage serves to create additional turbulence at the fuel tube discharge end thus achieving improved burner ignition. Igniter 46 operates in accord with the description set forth with reference to FIG. 3 and thus a description of its operation will not be repeated.

The post-mixed burner and ignition method of this invention serve to address and to overcome the problems of conventional post mixed burner ignition systems which were discussed above. First, the igniter is recessed from the fuel passage discharge end and thus is positioned well away from the combustion zone and the high temperatures and corrosive oxidizing conditions attendant thereto. Despite this well spaced positioning, the ignition system provides reliable ignition because, although the ignition flame is formed well away from the combustion zone, it is caused to flow to an into the combustion zone by the flowing action of the igniter oxidant and of the fuel.

Second, the flow of igniter oxidant within the igniter and over the electric surfaces such as around the sparking end, especially in conjunction with an electrode recessed within the igniter tube, serves to keep the electric surfaces clear of contaminants such as moisture, particulates and carbon. In this way moisture does not form on the electric surfaces thus avoiding corrosion and shorting out of the electrode, and particulates and carbon do not build up on the electric surfaces thus avoiding fouling. Instead, these impurities are swept away from the electric surfaces by the action of the flowing igniter oxidant, and out into the combustion zone.

Although the post-mixed burner and ignition method of this invention have been described in detail with reference to certain embodiments, those skilled in the art will recognize that there are other embodiments of the invention within the spirit and scope of the claims.

We claim:

1. A method for igniting a combustible mixture comprising:

(A) passing main oxidant into a combustion zone from the discharge end of a main oxidant passage;

(B) passing fuel into the combustion zone, separately from the main oxidant, from the discharge end of a fuel passage to form a combustible mixture in the combustion zone;

(C) passing igniter oxidant having an oxygen concentration greater than that of air through a tube containing an electrode into the fuel passage at an angle not exceeding 45 degrees to the direction in which the fuel is flowing toward the discharge end, at a point recessed from the discharge end of the fuel passage;

(D) creating a spark from the electrode to cause combustion of fuel and igniter oxidant within the fuel passage;

(E) passing combusting fuel and igniter oxidant from the fuel passage into the combustion zone to ignite the combustible mixture; and (F) terminating the flow of igniter oxidant while maintaining the flow of main oxidant into the combustion zone.

2. The method of claim 1 wherein the main oxidant is technically pure oxygen.

3. The method of claim 1 wherein the main oxidant is oxygen-enriched air.

4. The method of claim 1 wherein the igniter oxidant is passed through the tube at a flow rate within the range of from 8 to 50 cfh.

5. The method of claim 1 wherein the igniter oxidant is passed through the tube into the fuel passage proximate to the inside wall of the fuel passage.

6. The method of claim 1 wherein the igniter oxidant is passed through the tube into the fuel passage in substantially the same direction in which the fuel is flowing toward the discharge end.

7. The method of claim 1 wherein the igniter oxidant has an oxygen concentration of at least 30 percent.

8. A post-mixed burner comprising:

(A) a main oxidant passage having a discharge end for supplying main oxidant into a combustion zone;

(B) a fuel passage having a discharge end for supplying fuel into the combustion zone separately from the main oxidant; and (C) an igniter positioned within the fuel passage at an angle not exceeding 45 degrees to the direction of the fuel flow toward the discharge end, and recessed from the discharge end of the fuel passage, said igniter comprising a tube in flow communication with a source of oxidant having an oxygen concentration greater than that of air, and an electrode positioned within the tube, and further comprising means to terminate the flow of igniter oxidant while maintaining the flow of main oxidant into the combustion zone.

9. The burner of claim 8 wherein the main oxidant passage is a central passage and the fuel passage is concentrically oriented around and along the main oxidant passage.

10. The burner of claim 8 wherein the fuel passage is a central passage and the main oxidant passage is concentrically oriented around and along the fuel passage.

11. The burner of claim 8 wherein the fuel passage and the main oxidant passage are oriented side by side.

12. The burner of claim 8 wherein the fuel passage and main oxidant passage discharge ends are both in substantially the same plane.

13. The burner of claim 8 wherein the igniter is positioned within the fuel passage proximate to the inside wall of the fuel passage.

14. The burner of claim 8 wherein the igniter is positioned within the fuel passage in the same direction as the fuel flow toward the discharge end.

15. The burner of claim 8 wherein the electrode is electrically insulated along its length except for the end portion.

16. The burner of claim 8 wherein the electrode tip is flush with the end of the igniter tube.

17. The burner of claim 8 wherein the electrode tip is recessed from the end of the igniter tube.

18. The burner of claim 9 wherein the igniter is recessed within the fuel passage by from 4 to 12 inches.

* * * * *

UNITED STATES PATENT AND TRADEMARK OFFICE

CERTIFICATE OF CORRECTION

PATENT NO. : 4,892,475

DATED : January 9, 1990

INVENTOR(S) : D.R. Farrenkopf et al

It is certified that error appears in the above-identified patent and that said Letters Patent is hereby corrected as shown below:

In column 5, line 20 delete "an" and insert therefor --and--.

In claim 18, line 1 delete "9" and insert therefor --8--.

Signed and Sealed this

Eighteenth Day of December, 1990

*Attest:*

HARRY F. MANBECK, JR.

*Attesting Officer*

*Commissioner of Patents and Trademarks*